US007541980B2

(12) United States Patent
Shih

(10) Patent No.: US 7,541,980 B2
(45) Date of Patent: Jun. 2, 2009

(54) PRINTED ANTENNA

(75) Inventor: Yen-Yi Shih, Taipei-Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 123 days.

(21) Appl. No.: 11/558,476

(22) Filed: Nov. 10, 2006

(65) Prior Publication Data

US 2007/0241968 A1 Oct. 18, 2007

(30) Foreign Application Priority Data

Apr. 14, 2006 (TW) ..... 95113396 A

(51) Int. Cl.
*H01Q 1/38* (2006.01)

(52) U.S. Cl. ..... 343/700 MS; 343/702; 343/846

(58) Field of Classification Search ..... 343/702, 343/700 MS, 846, 829
See application file for complete search history.

(56) References Cited

U.S. PATENT DOCUMENTS 6,002,367 A * 12/1999 Engblom et al. ..... 343/700 MS
6,348,894 B1 * 2/2002 Lahti ..... 343/702
6,388,626 B1 * 5/2002 Gamalielsson et al. ..... 343/702
6,414,641 B1 * 7/2002 Carlson et al. ..... 343/702
6,515,625 B1 * 2/2003 Johnson ..... 343/700 MS
2006/0145925 A1 7/2006 Mei

* cited by examiner

*Primary Examiner*—Tho G Phan
(74) *Attorney, Agent, or Firm*—Wei Te Chung

(57) ABSTRACT

A printed antenna includes a radiation part (10) for radiating and receiving electromagnetic signals, a feed wire (30) for feeding the electromagnetic signals to the radiation part, a matching part (20) for impedance matching, and a ground plane (40). The radiation part includes a first radiation segment (12), a second radiation segment (14), and a third radiation segment (16). The second radiation segment is electrically connected to the first radiation segment and the third radiation segment. The feed wire is electrically connected to the radiation part. The matching part is electrically connected to the radiation part and the ground plane. The second radiation segment and the matching part extend from the first radiation segment to a same side of the first radiation segment.

18 Claims, 5 Drawing Sheets

PRINTED ANTENNA

BACKGROUND OF THE INVENTION

1. Field of the Invention

The present invention relates to printed antennas disposed on substrates, and particularly to a printed antenna disposed on a substrate in a wireless local area network (WLAN) device.

2. Description of Related Art

Wireless communication devices, such as mobile phones, wireless cards, and access points, radiate signals by use of electromagnetic waves. Thus, remote wireless communication devices can receive the signals without cables.

In a wireless communication device, an antenna is a key element for radiating and receiving radio frequency signals. Characteristics of the antenna, such as radiation efficiency, orientation, frequency band, and impedance matching, have a significant influence on the performance of the wireless communication device. Nowadays, there are two kinds of antennas: built-in antennas and external antennas. In contrast to the external antenna, the size of the built-in antenna is smaller, and the body of the built-in antenna is protected and not easily damaged. Thus, the built-in antenna is commonly employed in wireless communication devices. Common built-in antennas include low temperature co-fired ceramic antennas and printed antennas. The low temperature co-fired ceramic (LTCC) antenna has good performance at high frequencies and at high temperatures, but is expensive. The printed antenna has many types. A common type of printed antennas is a planar inverted-F antenna. Compared to low temperature co-fired ceramic antennas, planar inverted-F antennas are small, light, thin, and inexpensive. Accordingly, planar inverted-F antennas are being used more and more in wireless communication devices.

Referring to FIG. 5, a schematic diagram of a typical planar inverted-F antenna is shown. The planar inverted-F antenna includes a radiation part 10' and a matching part 20'. The radiation part 10' is for radiating and receiving radio frequency signals, and includes a first radiation segment 12' and a second radiation segment 14'. The matching part 20' is for impedance matching, and includes a first matching segment 22' and a second matching segment 24'. The radiation part 10' forms a resonator by the first radiation segment 12' electrically connecting to the second radiation segment 14'. The radiation part 10' is connected to the matching part 20' at one side of a grounding plane 40' to form the above-described planar inverted-F antenna.

Recently, more attention has been paid to developing small-sized and low-profile wireless communication devices. Antennas, as key elements of wireless communication devices, have to be miniaturized accordingly. Although, the above-described planar inverted-F antenna is smaller than an external antenna, the profile of the above-described planar inverted-F antenna cannot be reduced efficiently, and so the profile of the corresponding wireless communication device cannot be reduced efficiently either.

Therefore, a heretofore unaddressed need exists in the industry to overcome the aforementioned deficiencies and inadequacies.

SUMMARY OF THE INVENTION

In one aspect of the invention, a printed antenna includes a radiation part for radiating and receiving electromagnetic signals, a feed wire for feeding the electromagnetic signals to the radiation part, a matching part for impedance matching, and a ground plane. The radiation part includes a first radiation segment, a second radiation segment, and a third radiation segment. The second radiation segment is electrically connected to the first radiation segment and the third radiation segment. The feed wire is electrically connected to the radiation part. The matching part is electrically connected to the radiation part and the ground plane. The second radiation segment and the matching part extend from a same side of the first radiation segment.

In another aspect of the invention, a printed antenna includes a radiation part for radiating and receiving electromagnetic signals, a feed wire for feeding the electromagnetic signals to the radiation part, a matching part for impedance matching, and a ground plane. The feed wire is electrically connected to the radiation part. The matching part is electrically connected to the radiation part and the ground plane. A projection of the radiation part in the ground plane and a projection of the matching part in the ground plane overlap each other.

Other advantages and novel features will become more apparent from the following detailed description when taken in conjunction with the accompanying drawings, in which:

DETAILED DESCRIPTION OF THE INVENTION

Figure 1:
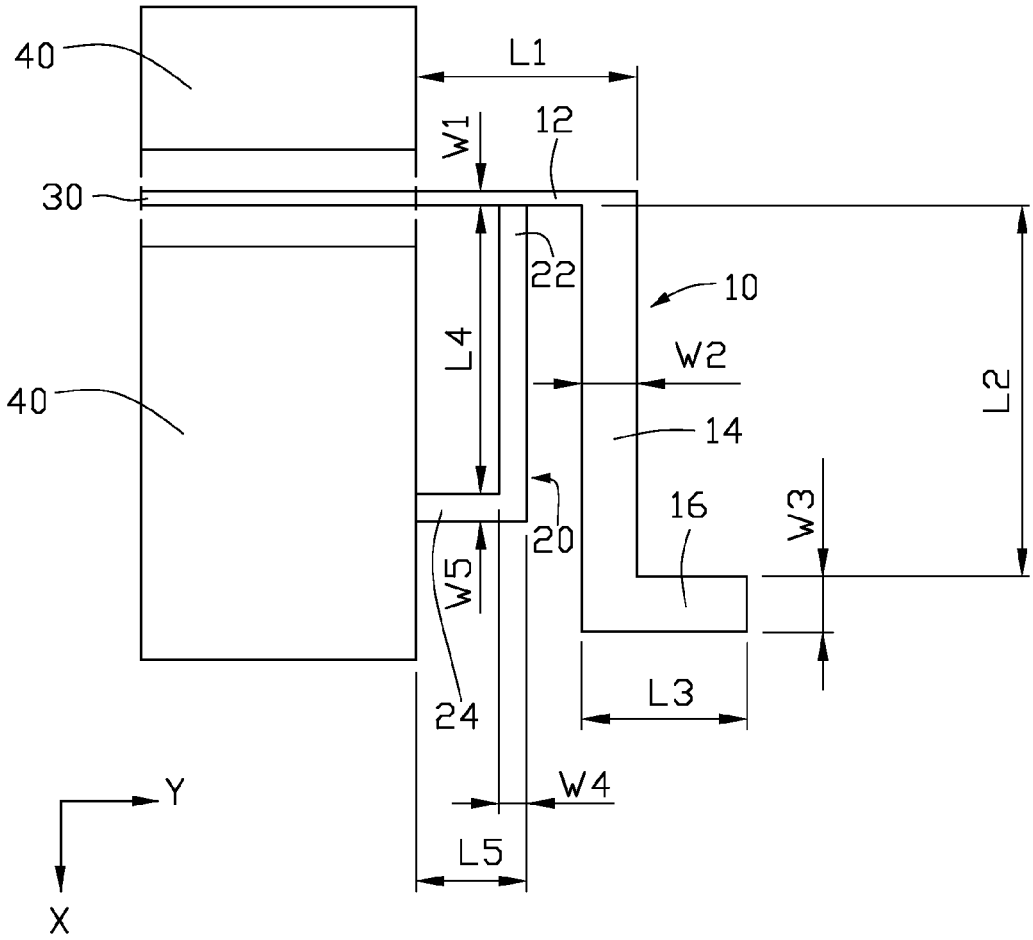
FIG. 1 is a schematic diagram of a printed antenna of an exemplary embodiment of the present invention.

Referring to FIG. 1, a printed antenna lying on a surface of a circuit board of an exemplary embodiment of the present invention includes a radiation part 10, a matching part 20, a feed wire 30, and a ground plane 40.

The radiation part 10 for radiating and receiving electromagnetic signals includes a first radiation segment 12, a second radiation segment 14, and a third radiation segment 16. The second radiation segment 14 is electrically connected to the first radiation segment 12 and the third radiation segment 16 to form the radiation part 10. The first radiation segment 12 and the third radiation segment 16 extend from opposite ends of the second radiation segment 14 respectively in opposite directions perpendicular to the second radiation segment 14. The first radiation segment 12 extends between the second radiation segment 14 and the ground plane 40 so as to definably divide a surface beside the ground plane 40 into two spatial quadrants, and the second radiation segment 14 is located in one of the two spatial quadrants.

The feed wire 30 is for feeding the electromagnetic signals to the radiation part 10, and is connected to the first radiation segment 12. The feed wire 30 and the first radiation segment 12 are located in a same line. In the exemplary embodiment, a characteristic impedance of the feed wire 30 is 50 ohm. The ground plane 40 is disposed on two sides of the feed wire 30.

The matching part 20 includes a first matching segment 22 and a second matching segment 24. The first matching segment 22 is electrically connected to the second matching segment 24 for impedance matching. The first matching segment 22 extends from one end of the second matching segment 24, and the other end of the second matching segment 24 is connected to the ground plane 40 for grounding. In the exemplary embodiment, the second matching segment 24 is perpendicular to the first matching segment 22.

Figure 2:
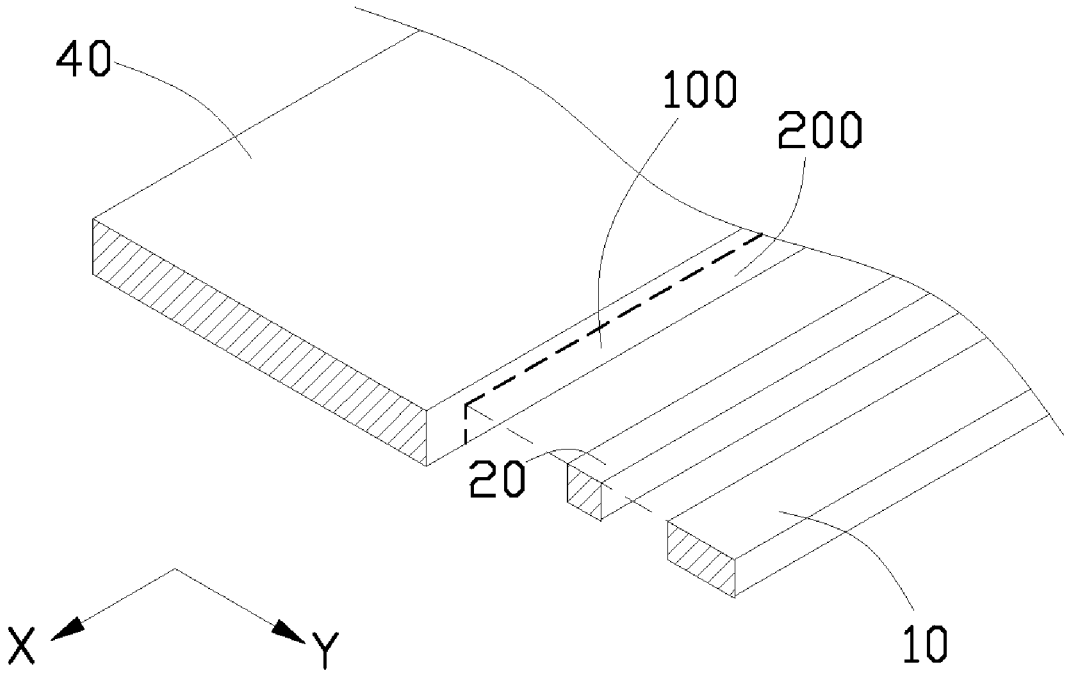
FIG. 2 is a schematic diagram of one part of projections of a radiation part and a matching part in a ground plane of the printed antenna of FIG. 1.

Referring also to FIG. 2, one part of a projection 100 of the radiation part 10 in the ground plane 40 and one part of a projection 200 of the matching part 20 in the ground plane 40 of the printed antenna of FIG. 1 is shown. The second radiation segment 14 and the first matching segment 22 extend from a same side of the first radiation segment 12, i.e., in the same one of the two spatial quadrants divided by the first radiation segment 12; that is, the projection 100 of the radiation part 10 in the ground plane 40 and the projection 200 of the matching part 20 in the ground plane 40 overlap each other. In the exemplary embodiment, the second radiation segment 14 and the first matching segment 22 perpendicularly extend from the first radiation segment 12. The first matching segment 22 of the matching part 20 extends approximately from a middle of the first radiation segment 12.

In the exemplary embodiment, the second matching segment 24 of the matching part 20 is parallel to the first radiation segment 12 and the third radiation segment 16, and the first matching segment 22 of the matching part 20 is parallel to the second radiation segment 14.

The radiation part 10, the matching part 20, the feed wire 30 and the ground plane 40 are all disposed on a substrate (not shown). A length of the feeding path of the radiation part 10 is about ¼ of a working wavelength of the electromagnetic signals transmitted therethrough. In the exemplary embodiment, the feeding path is a path of the electromagnetic signals flowing through the first radiation segment 12, the second radiation segment 14, and the third radiation segment 16.

In the exemplary embodiment, a length L1 of the first radiation segment 12 is about 8 millimeter (mm), a width W1 of the first radiation segment 12 is about 0.53 mm. A length L2 and a width W2 of the second radiation segment 14 are respectively about 13.47 mm and 2 mm. A length L3 and a width W3 of the third radiation segment 16 are respectively about 6 mm and 2 mm. A length L4 and a width W4 of the first matching segment 22 are respectively about 10.47 mm and 1 mm. A length L5 and a width W5 of the second matching segment 24 are respectively about 4 mm and 1 mm.

Figure 3:
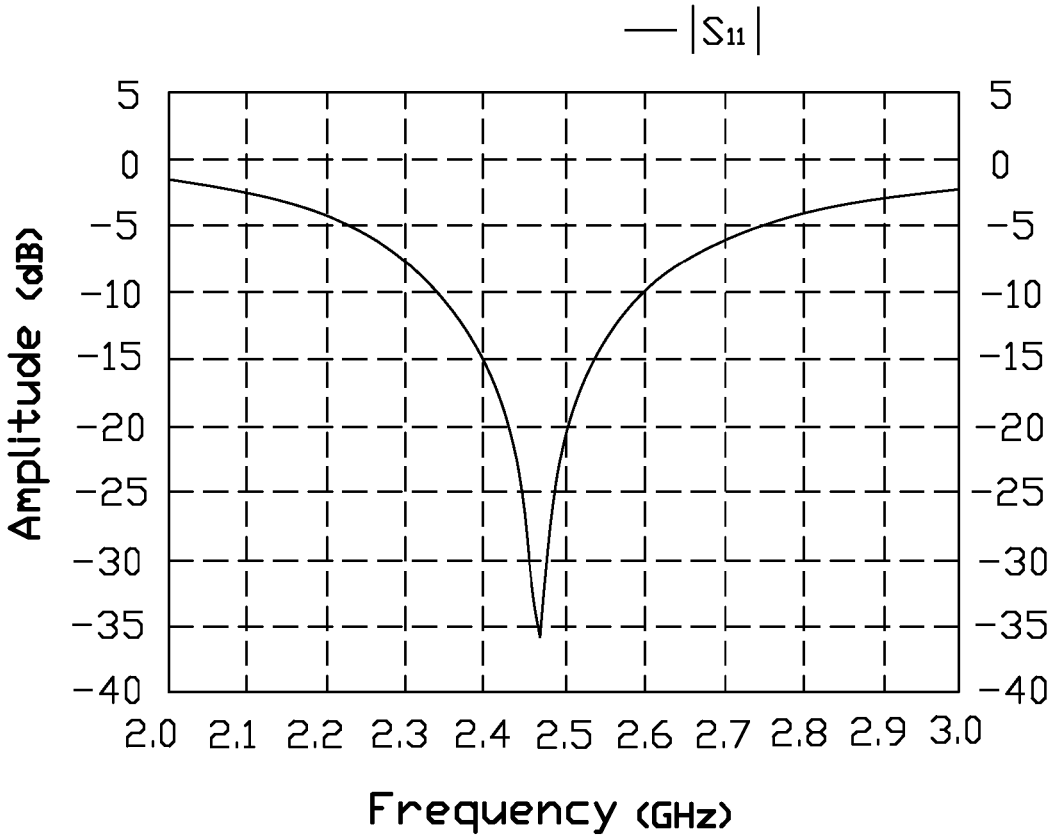
FIG. 3 is a graph of simulated test results showing reflection coefficient of the printed antenna of FIG. 1.

FIG. 3 is a graph of simulated test results showing reflection coefficient of the printed antenna of FIG. 1. As shown, when the printed antenna operates at working frequency bands of 2.4~2.5 GHz, its reflection coefficient is less than −10 dB, which is within operating standards set forth in IEEE 802.11b.

Figure 4:
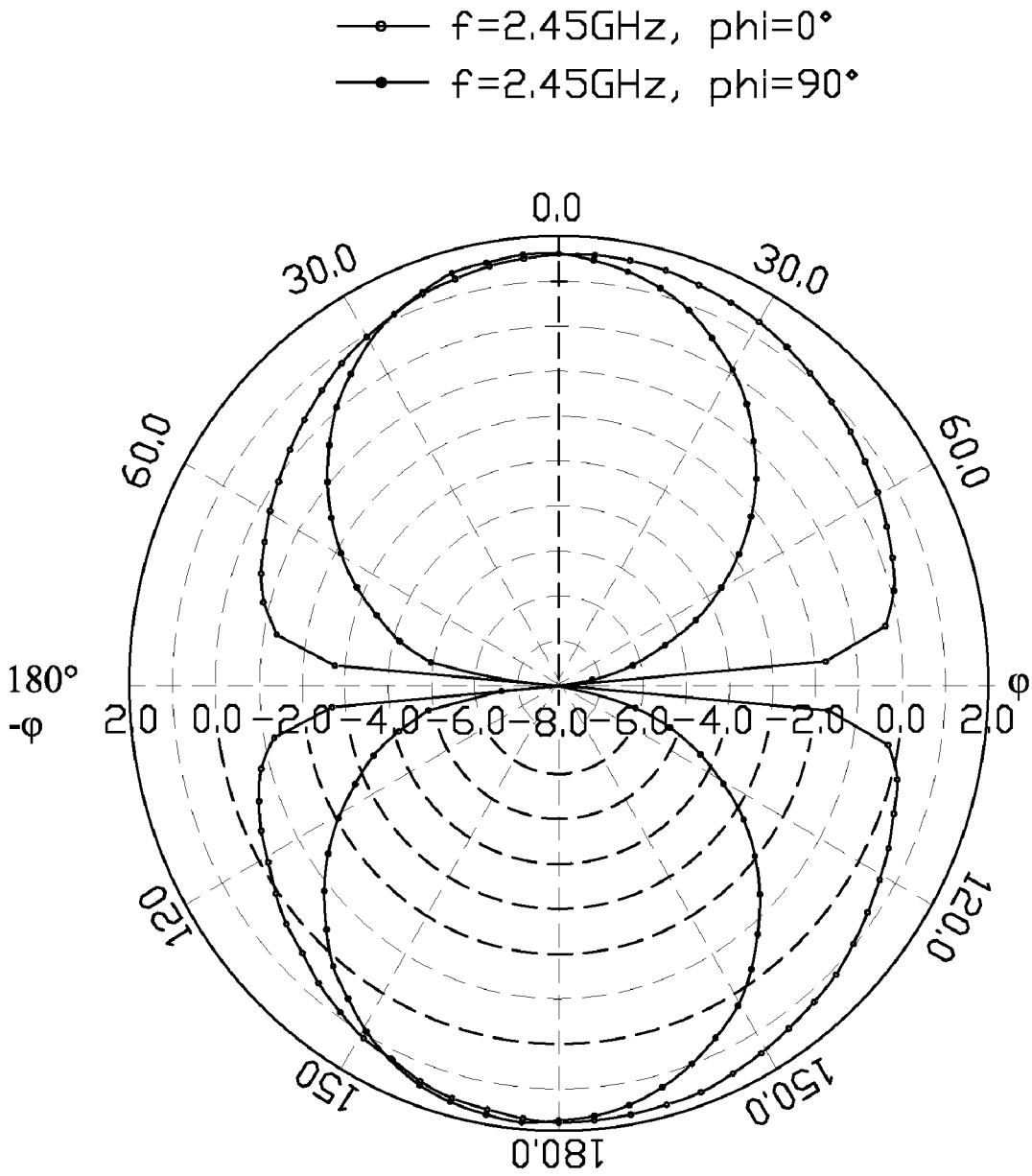
FIG. 4 is a graph of simulated test results showing a radiation pattern when the printed antenna of FIG. 1 is operated at 2.45 GHz.
Figure 5:
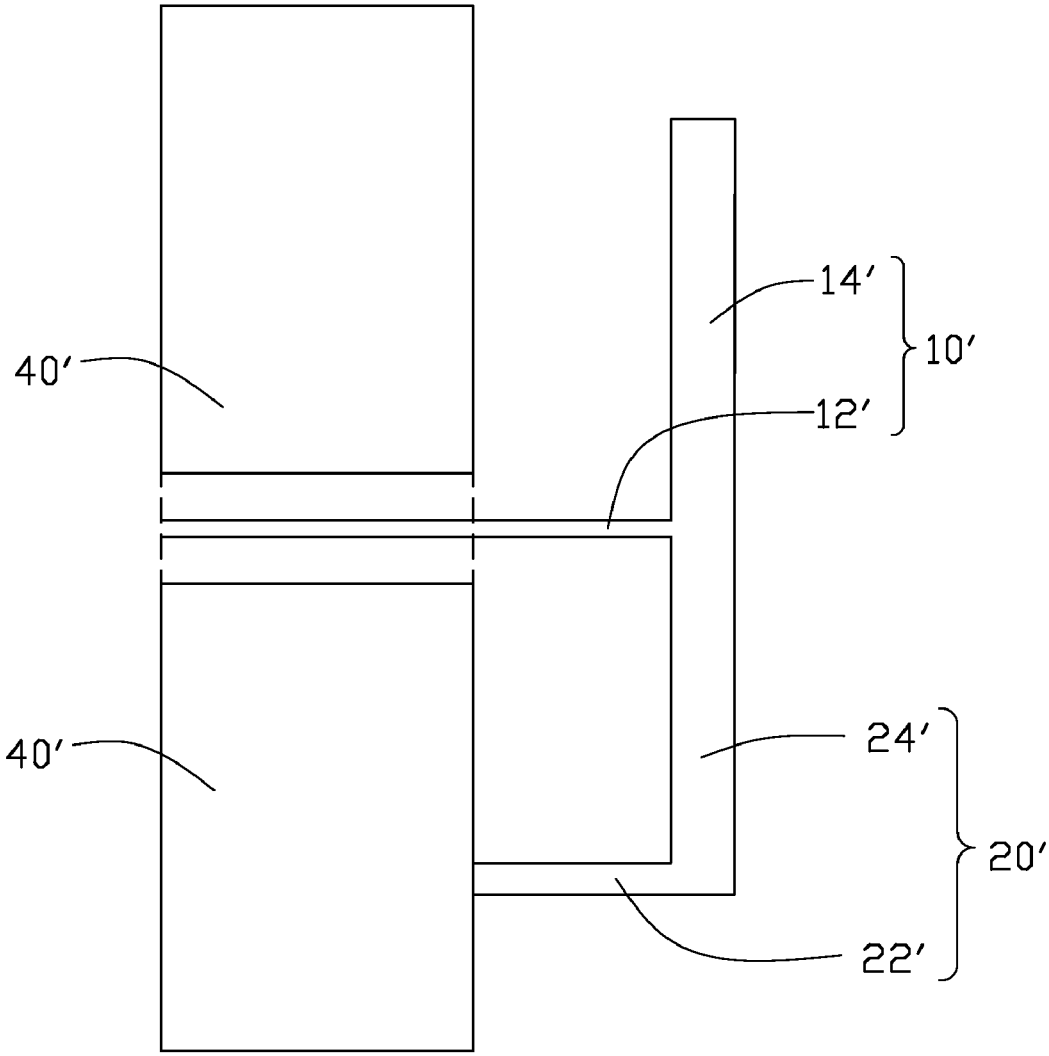
FIG. 5 (RELATED ART)
FIG. 5 is a schematic diagram of a conventional planar inverted-F antenna.

FIG. 4 is a test chart showing a simulated radiation pattern in a horizontal and a vertical plane when the printed antenna of FIG. 1 is operated at 2.45 GHz. It is to be noted that except for a plane where the printed antenna is placed, the printed antenna has well radiation performance at each direction, and the maximum value of the gain is 1.6 dB.

In other exemplary embodiments, lengths and widths of elements of the printed antenna can be changed, and the printed antenna can operate at other working frequencies.

While exemplary embodiments have been described above, it should be understood that they have been presented by way of example only and not by way of limitation. Thus the breadth and scope of the present invention should not be limited by the above-described exemplary embodiments, but should be defined only in accordance with the following claims and their equivalents.

What is claimed is:

1. A printed antenna, comprising:

a radiation part, for radiating and receiving electromagnetic signals, comprising a first radiation segment, a second radiation segment, and a third radiation segment, the second radiation segment electrically connected to the first radiation segment and the third radiation segment;

a feed wire electrically connected to the radiation part, for feeding the electromagnetic signals to the radiation part;

a ground plane; and a matching part electrically connected to the radiation part and the ground plane, for impedance matching;

wherein the second radiation segment and the matching part extend from a same side of the first radiation segment, and the second radiation segment and the matching part perpendicularly extend from the first radiation segment.

2. The printed antenna of claim 1, wherein the first radiation segment and the third radiation segment extend from opposite ends of the second radiation segment respectively in opposite directions perpendicular to the second radiation segment.

3. The printed antenna of claim 1, wherein the feed wire and the first radiation segment are located in a same line.

4. The printed antenna of claim 1, wherein the matching part extends approximately from a middle of the first radiation segment.

5. The printed antenna of claim 4, wherein the matching part comprises a first matching segment electrically connected to the first radiation segment, and one end of a second matching segment electrically connected to the first matching segment, and the other end is electrically connected to the ground plane.

6. The printed antenna of claim 5, wherein the first radiation segment and the third radiation segment are parallel to the second matching segment of the matching part.

7. The printed antenna of claim 1, wherein a length of a feeding path of the radiation part is about ¼ of a working wavelength of the electromagnetic signals transmitted therethrough.

8. The printed antenna of claim 7, wherein the feeding path is a path of the electromagnetic signals flowing through the first radiation segment, the second radiation segment, and the third radiation segment.

9. A printed antenna, comprising:

a radiation part, for radiating and receiving electromagnetic signals;

a feed wire electrically connected to the radiation part, for feeding the electromagnetic signals to the radiation part;

a ground plane; and a matching part electrically connected to the radiation part and the ground plane, for impedance matching;

wherein a projection of the radiation part in the ground plane and a projection of the matching part in the ground plane overlap each other.

10. The printed antenna of claim 9, wherein a length of the feeding path of the radiation part is about ¼ of a working wavelength of the electromagnetic signals transmitted therethrough.

11. The printed antenna of claim 10, wherein the feeding path is a path of the electromagnetic signals flowing through the radiation part.

12. The printed antenna of claim 9, wherein the matching part comprises a first matching segment electrically connected to the first radiation segment, and one end of a second matching segment is electrically connected to the first matching segment, and the other end is electrically connected to the ground plane.

13. The printed antenna of claim 12, wherein the radiation part comprises a first radiation segment, a second radiation segment, and a third radiation segment, the second radiation segment electrically connected to the first radiation segment and the third radiation segment.

14. The printed antenna of claim 13, wherein the second radiation segment is parallel to the first matching segment.

15. The printed antenna of claim 13, wherein the first radiation segment and the third radiation segment are parallel to the second matching segment.

16. An antenna comprising:

a ground plane extending along a surface;

a feed wire extending across said ground plane from a first side of said ground plane to a second side of said ground plane;

a radiation part electrically connectable with said feed wire at said first side of said ground plane for radiating and receiving electromagnetic signals, and comprising a first segment extending away from said first side of said ground plane to definably divide said surface beside said first side of said ground plane into two spatial quadrants, and a second segment extending from said first segment in one of said two spatial quadrants; and a matching part electrically connectable between said radiation part and said ground plane for impedance matching, and located in the same one of said two spatial quadrants as said second segment of said radiation part.

17. The printed antenna of claim 16, further comprising a third segment of said radiation part extending from said second segment of said radiation part and being parallel to said first segment of said radiation part.

18. The printed antenna of claim 16, wherein at least one of a projection of said second radiation part on said first side of said ground plane and a projection of said matching part on said first side of said ground plane is smaller than said first side of said ground plane in height.

* * * * *